US005107545A

United States Patent [19]

Potter

[11] Patent Number: 5,107,545

[45] Date of Patent: Apr. 28, 1992

[54] FISHERMAN'S FLY TYING APRON

[76] Inventor: Thomas Potter, 9 Woodland Rd., Sewickley, Pa. 15143

[21] Appl. No.: 637,326

[22] Filed: Jan. 3, 1991

[51] Int. Cl.[5] ..... A41D 13/00

[52] U.S. Cl. ..... 2/46; 2/48; 2/51

[58] Field of Search ..... 2/46, 48, 49 R, 49 A, 2/50, 51, 52, 69, 94, 108, 255, 118, 119; 224/183, 231, 210, 211, 906; 383/104, 119, 120, 121.1

[56] References Cited

U.S. PATENT DOCUMENTS

| | | | |
|---|---|---|---|
| 1,096,297 | 5/1914 | Gage | 2/51 |
| 1,879,341 | 9/1932 | Lapham | 2/94 X |
| 2,129,486 | 9/1938 | Berman | 2/51 |
| 2,265,690 | 12/1941 | Fiedler | 2/49 R |
| 2,518,357 | 8/1950 | Miles | 2/52 X |
| 2,538,677 | 1/1951 | Ferrand | 2/48 |
| 2,540,340 | 2/1951 | Linblade | 224/183 X |
| 2,648,845 | 8/1953 | Berman | 2/48 |
| 2,717,391 | 9/1955 | Bracken | 2/94 |
| 2,785,409 | 3/1957 | Lackey | 2/51 |
| 3,115,639 | 4/1963 | Moszczynski | 2/48 |
| 3,347,429 | 10/1967 | Ruth, Jr. | 224/211 |
| 3,801,985 | 4/1974 | Batt | 2/51 X |
| 3,886,508 | 5/1975 | Lavrard | 2/94 X |
| 4,114,199 | 9/1978 | Malan | 2/49 |
| 4,231,119 | 11/1980 | Quinn | 2/52 X |
| 4,412,369 | 11/1983 | Carnaghi | 2/52 X |
| 4,597,601 | 5/1952 | Sherman | 224/183 X |
| 4,637,075 | 1/1987 | Ingrisano et al. | 2/94 |
| 4,826,059 | 5/1989 | Bosch et al. | 224/901 X |
| 4,932,576 | 6/1990 | Ashley | 224/231 X |

FOREIGN PATENT DOCUMENTS

| | | | |
|---|---|---|---|
| 560743 | 9/1957 | Belgium | 2/51 |
| 1298698 | 6/1962 | France | 2/51 |

OTHER PUBLICATIONS

Gershman, Maurice, "Self-Adhering Nylon Tapes", the J.A.M.A., vol. 168, No. 7, Oct. 1958.

*Primary Examiner*—Werner H. Schroeder
*Assistant Examiner*—Jeanette E. Chapman
*Attorney, Agent, or Firm*—Webb, Burden, Ziesenheim & Webb

[57] ABSTRACT

The present invention is directed to a fisherman's apron and more particularly to a fisherman's fly tying apron which includes an upper section including means for attaching said fly tying apron to a user, a lower section detachable from the upper section, a waste collecting means associated with the lower section, and a stiffening means associated with either the lower section or the waste collecting means. The apron of the present invention permits the fly tier to have easy access to fly tying supplies and tools and provides a convenient workplace to tie the flies as well as an easily emptied waste collection pocket.

12 Claims, 2 Drawing Sheets

FISHERMAN'S FLY TYING APRON

BACKGROUND OF THE INVENTION

1. Field of the Invention

The present invention relates to the field of aprons generally and, particularly, to the field of aprons directed to the sport of fishing and, still more particularly, to the field of fishing aprons directed to the art of fly tying.

2. Description of the Prior Art

Fishermen often use artificial insect and other bait imitations commonly known as "flies" in order to successfully catch their prey. While fully assembled flies can be purchased, the truly avid fisherman will often desire to make or "tie" his own fly so that he can modify it as necessary to match the conditions of a stream or lake and/or for a particular fish. While flies vary widely in their configurations, the basic elements usually include a hook, synthetic materials and/or feathers, with the synthetic materials and feathers typically being wrapped around or otherwise attached to the hook with thread or string.

In order to be effectively prepared for various fish and fishing conditions, the fisherman who ties his own flies will often develop several different flies and needs to have access to a formidable array of hooks, feathers, strings, tools and related paraphernalia, as well as a stable and organized workplace within which he can tie his various flies.

Several attempts have been made in the prior art to provide fishing garments or aprons which organize fisherman's paraphernalia. Examples include U.S. Pat. Nos. 4,723,695; 4,151,938; 2,853,709; 2,717,391; 2,616,598; 2,538,677; 2,171,676 and 193,054. However, the majority of these patents are directed to organizing fishing tackle, and do not provide for the organization of fly tying materials and tools. Nor do the majority of these patents provide a workplace within which a fisherman can tie his flies. Nor do these examples provide a convenient method of collecting and discarding of fly tying waste products.

Thus, there remains a need in the art for a fishing garment which will permit those fishermen who tie their own flies to effectively organize and provide access to the aforementioned formidable array of hooks, feathers, strings, tools and related paraphernalia, as well as provide a stable and organized workplace within which he can tie his flies. A need also remains for a method of quickly and easily collecting and discarding fly tying waste products.

SUMMARY OF THE INVENTION

It is the object of the present invention to fulfill this need by providing a fisherman's fly tying apron which effectively organizes the materials necessary to tie flies and provides a stable and organized workplace wherein the flies can be tied.

It is a further object of the present invention to provide a fly tying apron which is capable of collecting fly tying waste products which is also quickly and easily cleaned.

It is a more specific object of the present invention to provide a fly tying apron with a collecting pocket which will trap and hold fly tying waste products until such products are to be discarded.

It is another object of the present invention to provide a fly tying apron which includes a detachable lower section which includes the collecting pocket to assist with the disposal of fly tying waste products.

It is another object of the present invention to provide a fly tying apron which includes a magnetic material associated with said detachable lower section to assist in the separation and retention of metallic hooks from the feathers and string.

It is still another object of the present invention to provide a fly tying apron with an adjustable fastening strap which can be worn comfortably by fishermen of several different heights and weights.

These objects and other advantages are attained by a fly tying apron in accordance with the present invention which in one embodiment comprises an upper section including a device for attaching the fly tying apron to a user; a lower section detachable from the upper section; and a waste collecting device associated with the lower section.

In a preferred embodiment of the present invention, the device for attaching the fly tying apron to the user is adjustable to accommodate the various heights and weights of users.

In one embodiment of the present invention, the upper section also includes one or more tool and equipment retaining devices.

In another embodiment of the present invention, the lower section includes a magnetic material to assist in the separation of metallic tools and equipment from the non-metallic fly tying equipment and supplies.

In a preferred embodiment of the present invention, the waste collecting means is a pocket. Preferably, the pocket includes a stiffening element to provide a stable flat workplace on the lap of the user when the user assumes a sitting position while wearing the apron.

DESCRIPTION OF THE PREFERRED EMBODIMENTS

Figure 1:
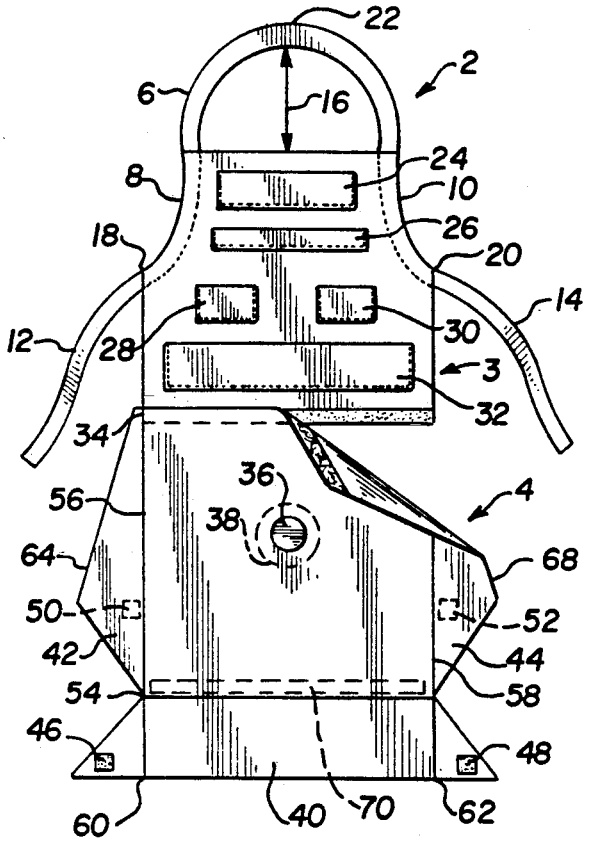
FIG. 1 is a front view of one embodiment of a fly tying apron in accordance with the present invention showing the collecting pocket in an open position.

Referring now to FIG. 1, fly tying apron 1 includes three main sections: adjustable apron tie strap 2, upper section 3 and lower section 4.

Adjustable apron tie strap 2 includes loop 6, loop 6 inherently having a first and second end which is placed over the wearer's head and rides on the wearer's neck when the wearer dons fly tying apron 1. Adjustable tie strap 2 may be comprised of any material known in the art which is long-lasting and comfortable to wear. Preferred materials are nylon webs or straps which are resistant to damage from water or perspiration. Each end of loop 6 is slideably maintained within apron tie strap channels 8, 10 (shown in phantom) which are formed in the left and right peripheral edges of upper section 3. The ends of loop 6 exit channels 8, 10 forming apron tie strap arms 12, 14 each of said tie strap arms having an end. Said tie strap arms are placed under the wearer's arms and each of said ends are tied to each other behind the wearer's back thus securely fastening fly tying apron 1 to the wearer's body. Because apron tie strap 2 is slideably maintained in channels 8 and 10, distance 16 can be varied as desired by the wearer of fly tying apron 1. This permits fly tying apron 1 to be adjusted to a wide variety of wearer's heights and weights. If a wearer desires to maintain a specific fixed distance 16, the wearer may do so by tying knots at points 18 and 20 of sufficient size to prevent the knots from entering channels 8 and 10. In an alternative embodiment, apron tie strap 2 is fixedly held within channels 8 and 10 and loop 6 is cut at or about point 22 creating two separate apron tie strap arms, each of said arms having a first and second end. The first two ends of the tie strap arms nearest the wearer's neck are placed behind the wearer's neck and tied to one another. The distance 16 can then be varied according to how tightly the ends are looped over one another and tied. The remaining two second ends of the tie strap arms are tied behind the wearer's back as previously described.

Upper section 3 of fly tying apron 1 includes tool retaining device 24. Tool retaining device 24 can encompass a wide variety of embodiments. It may include a pair of horizontal spaced elastic strips fastened at each end to upper section 3. Alternatively, it may include a tray-like device or a shelf-like device. In still another embodiment, retaining device 24 is a simple pocket or flap which is either removably or permanently affixed to upper section 3. Permanent attachment is achieved by means known in the art such as stitches or rivets. Removable attachment is also achieved by means known in the art such as buttons, zippers or loops and hook fasteners such as Velcro®, a registered trademark of Velcro USA, Inc., of Manchester, N.H.

Upper section 3 is made of any material known in the art which is long-lasting and comfortable. In one embodiment, upper section 3 is made of a denim material. In another embodiment, upper section 3 is made of a plastic or nylon material which is water resistant and easily cleaned.

Upper section 3 also optionally includes magnet 26 which is affixed to upper section 3 by means known in the art. Magnet 26 functions to retain metallic items such as hooks or tools for easy access by the wearer.

Upper section 3 further includes one or more additional retaining devices. These retaining devices may take any of the configurations as described for retaining device 24. These additional retaining devices may alternatively include a hook retaining device, a feather retaining device, a string retaining device and/or a miscellaneous materials retaining device. As shown in FIG. 1, in a preferred embodiment of the present invention, upper section 3 includes retaining devices 28, 30 and 32. While retaining devices 28 and 30 are shown as significantly smaller than retaining device 32 and are also shown above retaining device 32 on upper section 3, the exact size and placement of these retaining devices is not critical to the present invention.

Figure 4:
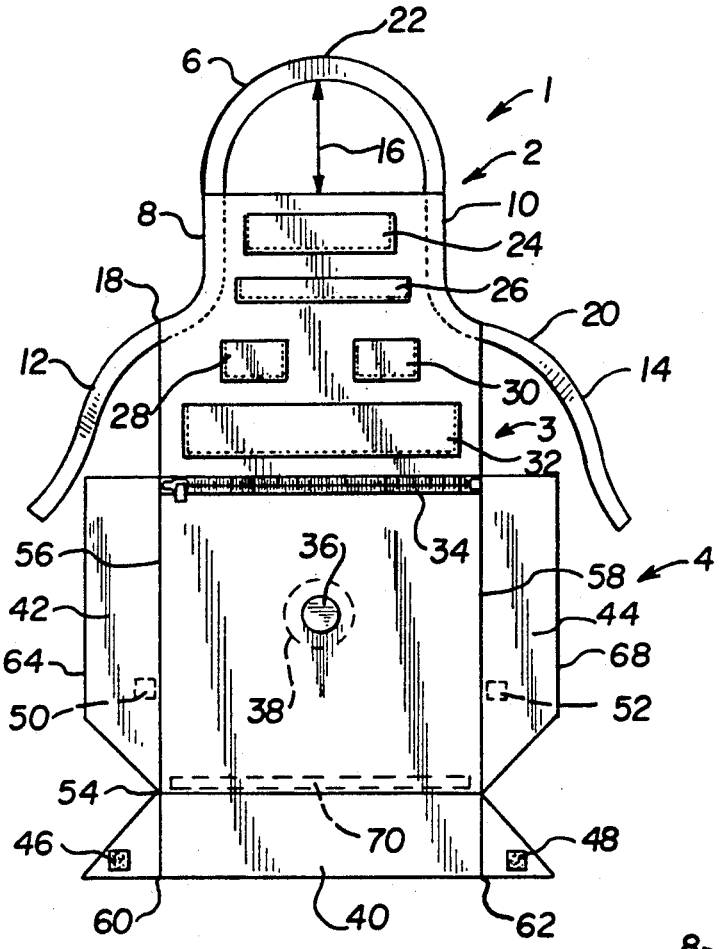
FIG. 4 is a front view of another embodiment of the fly tying apron in accordance with the present invention showing the collecting pocket in an open position connected to the upper section of the fly tying apron with a zipper and also showing the collecting pocket with non-sloped side flaps.

Interposed between and formed integrally as a part of both upper section 3 and lower section 4 of fly tying apron 1 is connecting device 34. Connecting device 34 functions to removably attach lower section 4 to upper section 3 of fly tying apron. In one embodiment, connecting device 34 is a hook and loop fastening device such as Velcro® as shown in FIG. 1. In another embodiment as shown in FIG. 4, connecting device 34 is a zipper. Connecting device 34 permits the quick and easy detachment of lower section 4 from upper section 3 whereupon the wearer can quickly and easily clean lower section 4 when it contains fly tying waste products.

Lower section 4 includes magnet 36 which functions to separate magnetic materials such as hooks from non-magnetic materials such as feathers during fly tying operations. The exact placement of magnet 36 on lower section 4 is not critical to the present invention, however in a preferred embodiment, magnet 36 is positioned in a central portion of lower section 4 when the wearer of the apron assumes a sitting position. In one embodiment, magnet 36 is sewn into the fabric of lower section 4. In another embodiment, a metal plate 38 (shown in phantom) is either sewn into the material of lower section 4 or securedly affixed to the back of section 4 whereupon magnet 36 is held magnetically over metal plate 38 on the front surface of lower section 4.

Lower section 4 further includes bottom flap 40 and a pair of symmetrical side flaps 42, 44, all of which are integrally formed as a part of lower section 4. Bottom flap 40 includes fastening devices 46 and 48 located generally on the peripheral left and right edges of flap 40. Side flaps 42, 44 similarly include fastening devices 50, 52, respectively (shown in phantom) which are located on the underside of side flaps 42, 44 as viewed from the orientation of FIG. 1. When bottom flap 40 is folded along fold line or edge 54 and side flaps 42 and 44 are folded along fold line or edges 56 and 58 respectively, a collecting pocket is formed bounded by bottom flap 40 and side flaps 42, 44, which will collect and retain fly tying waste products. The collecting pocket is securely maintained by folding the left and right edges of flap 40 along fold lines or edges 60, 62, whereupon fastening devices 46, 48 securely fasten themselves to corresponding fastening devices 50, 52 respectively. The exact size of the areas occupied by fastening devices 46, 48, 50 and 52 are not critical to the present invention. However, the size of the areas of fastening devices 46, 48 should correspond to the size of the areas of fastening devices 50, 52, respectively. The collecting pocket created should be of sufficient size so as to effectively trap and retain fly tying waste products. Fastening devices 46, 48, 50 and 52 may be made from any materials known in the art, but in a preferred embodiment are made from Velcro®. Lower section 4 can be comprised of any material known in the art which is comfortable and long-lasting. In a preferred embodiment, lower section 4 is comprised of a nylon or vinyl-type material which is easily cleaned and is a non-sticking surface from which feathers are easily removed.

Side flaps 42, 44 are shown in FIG. 1 in one embodiment wherein peripheral edges 64, 68 slope gradually outwardly from lower section 4 of apron 1 along a direction extending from the area of association of side flaps 42, 44 with section 3 of apron 1 towards flap 40. When side flaps 42, 44 are sloped in this manner, the collecting pocket formed has sloped side walls as shown in FIGS. 2 and 3.

Figure 5:
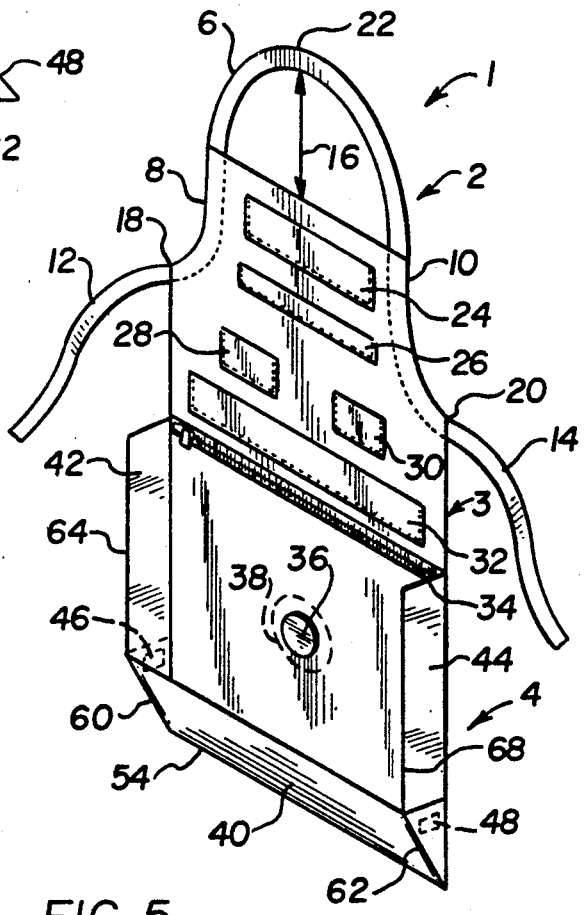
FIG. 5 is a perspective view of the fly tying apron of FIG. 4 showing the collecting pocket in a closed position.

In an alternative embodiment, as shown in FIG. 4, peripheral edges 64, 68 of side flaps 42, 44 respectively are not gradually sloped, and the collecting pocket formed will have non-sloped side walls as shown in FIG. 5.

A preferred embodiment of the present invention includes stiffener 70, shown in phantom in FIGS. 1 and 4. Stiffener 70 is formed integrally as a part of section 4. Also in a preferred embodiment, stiffener 70 extends the entire width of section 4. Stiffener 70 functions to create a flat workplace across the wearer's lap when the wearer is seated. Stiffener 70 may be formed of any materials known in the art. In a preferred embodiment, stiffener 70 is a plastic, wire or rod material which is long lasting and resistant to water damage. In one embodiment, stiffener 70 is permanently securedly affixed to section 4 by means known in the art. These means include but are not limited to gluing, taping or sewing stiffener 70 to section 4. In another embodiment, stiffener 70 is removably affixed to section 4. One advantage of this embodiment is that stiffener 70 can be removed from fly tying apron 1 to facilitate laundering of fly tying apron 1. The exact dimensions with respect to the thickness or diameter of stiffener 70 are not critical so long as it is of sufficient strength to provide and maintain a flat working area across section 4 when the wearer wears fly tying apron 1 in a sitting position. Where lower section 4, bottom flap 40 and side flaps 42, 44 are made of relatively stiff material which forms a stable workplace, stiffener 70 is not needed.

Figure 2:
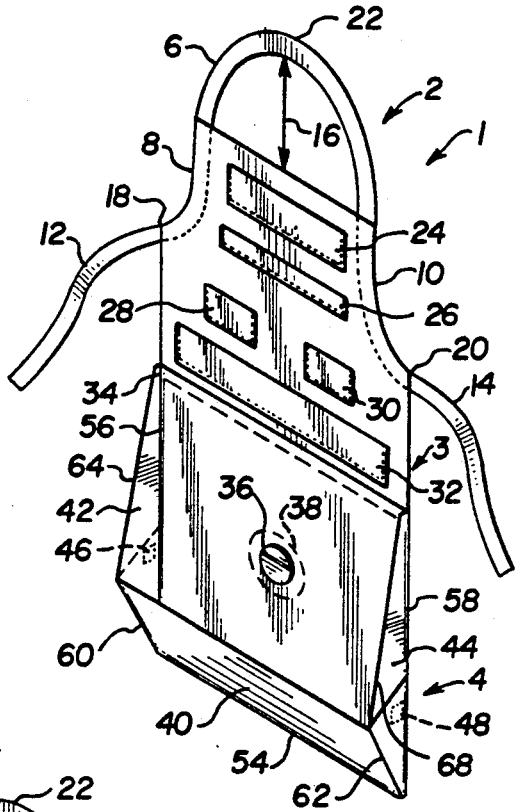
FIG. 2 is a perspective view of the fly tying apron shown in FIG. 1, showing the collecting pocket in a closed position.
Figure 3:
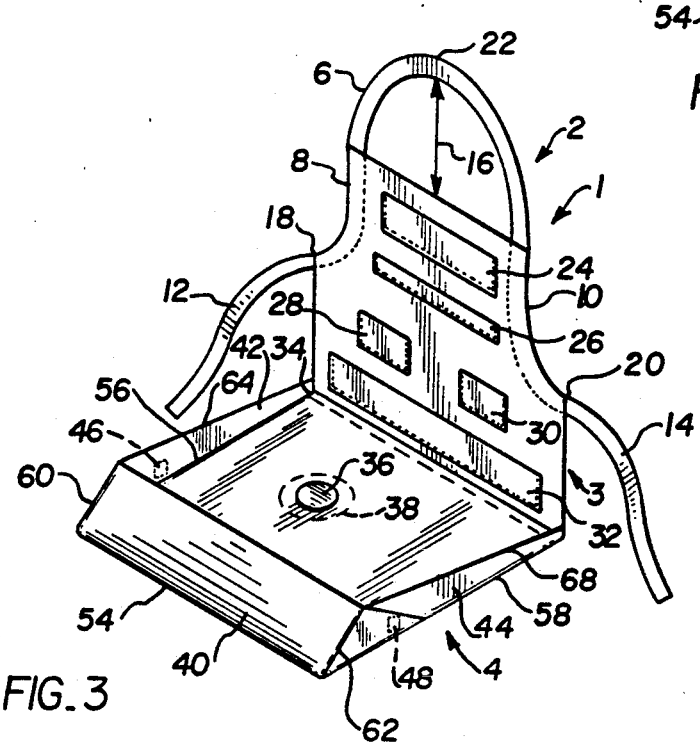
FIG. 3 is a perspective view of the fly tying apron shown in FIG. 1 when worn by a user in a sitting position, showing the formation of a stable workplace.

FIG. 2 is a front view of fly tying apron 1 showing bottom flap 40 and side flaps 42, 44 folded along edges 54, 56, 58, 60 and 62 respectively to form a collecting pocket. Fastening devices 46, 48, and 50, 52, respectively are joined and are shown in phantom in FIG. 2.

FIG. 3 is a perspective view of fly tying apron 1 showing the orientation of fly tying apron 1 when worn by a wearer in a sitting position, and the formation of a flat stable workplace.

A fisherman using fly tying apron 1 dons fly tying apron 1 by placing loop 6 over his or her head, slideably adjusting the height of fly tying apron 1 as desired and, subsequently joining apron tie strap arms 12 and 14 behind his or her back whereupon they are tied one to another to securely fix fly tying apron 1 to the fisherman's body.

Upon assuming a sitting position as shown in FIG. 3, a flat stable workplace is formed across the fisherman's lap whereupon flies may be tied. The necessary tools, feathers, strings and hooks are at the fisherman's immediate disposal through the use of retaining devices 24, 28, 30 and 32 as well as magnetic strip 26. While tying flies on his lap above lower section 4, if the fisherman should drop small metallic tools or hooks within a mass of feathers he need only slightly shake all of the materials near magnet 36 whereupon small metallic tools and hooks will become affixed to magnet 36 and are thereby quickly and easily separated and recovered.

As shown in FIG. 3, the natural slope of the lap will cause fly tying waste products to gather in the collecting pocket. When the fisherman has finished his or her fly tying operations, he or she simply stands and unfastens retaining devices 46, 48 from corresponding retaining devices 50 and 52, respectively and pivots bottom flap 40 whereupon the contents of the pocket can be transferred to an appropriate waste receptacle. Alternatively, the fisherman can, upon standing, simply detach and remove lower section 4 by releasing connecting device 34, whereupon the entire lower section 4 can be emptied into the appropriate waste container.

Having described the presently preferred embodiments of my invention, it is to be understood that it may otherwise be embodied within the scope of the appended claims.

I claim:

1. A fly tying apron comprising:

a means for attaching said fly tying apron to a user;

an upper section associated with said means for attaching said fly tying apron to said user wherein said upper section includes a retaining means for holding fly tying tools and supplies;

a lower reusable section associated with said upper section having a means for detachably connecting said lower section from said upper section;

a stiffener associated with said lower reusable section;

a magnet removably attached on said lower reusable section; and a waste collecting means of sufficient rigidity to form a pocket defined by closed end walls associated with said lower section;

whereby said lower reusable section, said stiffener, said waste collecting means and said end walls cooperate to form a tray like work surface when said user assumes a sitting position wearing said fly tying apron and whereby metallic objects associated with fly tying are retained and separated from non-metallic objects by said magnet and whereby waste material generated during fly tying collects in said waste collecting means and said waste material is emptied from said waste collecting means by either detaching said lower reusable section from said upper section or opening said closed end walls.

2. The fly tying apron of claim 1 wherein said adjustable apron tie strap includes:

a loop having a first and second end;

a pair of apron tie strap channels formed in said upper section wherein said first and said second end of said loop are inserted into said pair of channels and are slideably maintained therein; and a pair of apron tie strap arms, wherein said pair of tie strap arms are formed as extensions of said first and said second end of said loop.

3. The fly tying apron of claim 1 wherein said upper section includes a magnet.

4. The fly tying apron of claim 1 wherein said upper section is made of plastic.

5. The fly tying apron of claim 1 wherein said upper section is made of nylon.

6. The fly tying apron of claim 1 wherein said connecting means for associating said upper section with said lower section is a zipper.

7. The fly tying apron of claim 1 wherein said connecting means for associating said upper section with said lower section utilizes a hook and loop retaining means.

8. The fly tying apron of claim 1 wherein said waste collecting means includes a collecting pocket and a tray-like work area defined by said closed end walls, said pocket being formed by folding together a bottom flap and a pair of symmetrical side flaps, wherein said bottom flap and said side flaps are integrally formed with said lower section wherein said bottom flap includes a fastening means which cooperates with fastening means associated with each of said side flaps, whereby said fastening means operates to affix said bottom flap and said side flaps to one anther when all of said flaps are folded together to form said collecting pocket and said tray-like work area.

9. The fly tying apron of claim 8 wherein said fastening means is a loop and hook means.

10. The fly tying apron of claim 8 wherein said side flaps are sloped gradually outwardly from said lower section.

11. The fly tying apron of claim 1 wherein said stiffener is a rod.

12. The fly tying apron of claim 1 wherein said stiffener is a wire.

* * * * *

UNITED STATES PATENT AND TRADEMARK OFFICE

CERTIFICATE OF CORRECTION

PATENT NO. : 5,107,545

DATED : April 28, 1992

INVENTOR(S) : Thomas Potter

It is certified that error appears in the above-identified patent and that said Letters Patent is hereby corrected as shown below:

Column 2, line 1:

Cover page, under References Cited U.S. PATENT DOCUMENTS
"4,597,601 5/1952 Sherman ... 224/183 X" should read
--2,597,601 5/1952 Sherman ... 224/183 X--.

Column 4 Line 3 after "apron" insert --1--.

Claim 8 Line 66 Column 6 "anther" should read --another--.

Signed and Sealed this

Sixth Day of July, 1993

*Attest:*

Michael K. Kirk

MICHAEL K. KIRK

*Attesting Officer*

*Acting Commissioner of Patents and Trademarks*